US005803450A

United States Patent [19]

Brokate et al.

[11] Patent Number: 5,803,450

[45] Date of Patent: Sep. 8, 1998

[54] DEVICE FOR CONVEYING FLAT FLOPPY PRODUCTS

[75] Inventors: Heido Brokate, Itzehoe; Ralph Jakob, Hohenlockstedt; Friedrich Jarchow, Essen; Rudolf Stäb, Frankenthal; Klaus-Jürgen Taubert, Hohenlockstedt; Ming Liu, Bochum, all of Germany

[73] Assignee: Koenig & Bauer-Albert Aktiengesellschaft, Wurzburg, Germany

[21] Appl. No.: 635,953

[22] PCT Filed: Nov. 1, 1994

[86] PCT No.: PCT/EP94/03579

§ 371 Date: Jul. 8, 1996

§ 102(e) Date: Jul. 8, 1996

[87] PCT Pub. No.: WO95/12540

PCT Pub. Date: May 11, 1995

[30] Foreign Application Priority Data

Nov. 2, 1993 [DE] Germany ..... 43 37 410.7

[51] Int. Cl.[6] ..... B65H 5/34

[52] U.S. Cl. ..... 271/270; 271/202; 271/203

[58] Field of Search ..... 271/203, 202, 271/270

[56] References Cited

U.S. PATENT DOCUMENTS 3,994,221 11/1976 Littleton ..... 271/202 X
4,184,392 1/1980 Wood .
4,601,387 7/1986 Köbler .

FOREIGN PATENT DOCUMENTS 0 141 136 5/1985 European Pat. Off. .
0 498 068 8/1992 European Pat. Off. .
646 002 5/1937 Germany .
1 189 919 3/1965 Germany .
27 57 448 7/1978 Germany .

OTHER PUBLICATIONS

Patent Abstracts of Japan; Pub. No. JP46002953 Dated Jan. 1989; vol. 13, No. 163.

*Primary Examiner*—David H. Bollinger
*Attorney, Agent, or Firm*—Jones, Tullar & Cooper, P.C.

[57] ABSTRACT

A device for conveying flat floppy products has an inlet conveyor belt with a constant velocity, an intermediate conveyor belt with a periodically changing velocity and an outlet conveyor belt with constant velocity. The intermediate conveyor belt causes a deceleration or acceleration of the product to be conveyed. Transfer of the product between the conveyor belts takes place at respectively the same velocities of the affected belts. The drive of the intermediate conveyor belt is performed by a gear making periodic gear changes. The invention relates to the relationship between the shaft distance and the radius of the drive pulley of the intermediate conveyor belt and is particularly related to steps reducing the torque during acceleration or deceleration of the drive elements and assuring a slip-free conveyance of the products.

9 Claims, 8 Drawing Sheets

DEVICE FOR CONVEYING FLAT FLOPPY PRODUCTS

FIELD OF THE INVENTION

The present invention relates to a first device intended to bring flat products of low flexural strength, such as sheets or sheet packages of paper or plastic, from a constant inlet velocity $v_E$ to a second constant outlet velocity $v_A$. The conveyance of packages of printed sheets, which must be slowed from a high inlet velocity to a reduced outlet velocity in order to effect an adaptation to the processing speed of a folding apparatus, can be cited as an example.

DESCRIPTION OF THE PRIOR ART

DE 1 189 919 A1 describes a device consisting of an inlet conveyor belt of a constant velocity, an intermediate conveyor belt with a periodically changing velocity, and an outlet conveyor belt. The transfer of the product to be conveyed from one belt to the next belt respectively takes place at the same velocity of the involved belts. The intermediate conveyance causes an acceleration of the product to a higher velocity. It is driven by a gear making periodic gear changes. Periodic gears are known. The gear with non-circular wheels disclosed in DE 646 002 A can be cited as an example.

In connection with products of a length L, which follow each other at a clock time T, the distance "a" between the shafts of the reversing pulleys of the intermediate conveyor belt is composed of the length L and the deceleration length $L_V$ in the case of a product deceleration and, in the case of a product acceleration, of the length L and the acceleration length $L_B$.

Relatively short clock times T require comparatively large accelerations and decelerations of the intermediate conveyor belt. Relatively large inertia forces are generated by this, which can result in the breakdown of drive elements. In addition, there is the danger that the products will slide, change their distance and in this way interfere with the clocked operation.

SUMMARY OF THE INVENTION

The object of the present invention is to disclose the relationship between the shaft spacing distance "a" between of the reversing pulleys and the radius of the drive pulley r of the intermediate conveyor belt, to keep the inertia forces as low as possible and to assure a slip-free conveyance of the products.

In accordance with the invention, the shaft spacing distance "a" is considered to be a part of the circumference of a replacement or theoretical pulley with a radius R, parts of the circumference of which are the angle ranges $\phi_E$ for the constant inlet velocity $v_E$, $\phi_V$ for the deceleration range, $\phi_A$ for the constant outlet velocity $v_A$, and $\phi_B$ for the acceleration range, and which theoretical pulley makes one revolution during the clock time T, so that the relationship "a"= $L+R\phi_V$ applies in the case of product deceleration, or "a"=$L+R\phi_B$ for the case of product acceleration.

An actual drive pulley of a radius R would be of too large a size and would therefore have too large mass moments of inertia. In order to keep the deceleration and acceleration torque as small as possible at a predetermined periodic movement cycle and shaft spacing distance "a" of the reversing pulleys of the intermediate conveyor belt, the invention provides a considerably smaller radius r of the actual drive pulley of the intermediate conveyor belt than that of the radius R of the theoretical or replacement pulley. This is achieved in that gear wheel stages, which provide gearing up to a faster speed, are disposed between the periodic gear and the drive pulley and as a whole have a total gear level in an amount of $i<1$. Without a change in the speeds of the intermediate conveyor belt, the radius of the drive pulley then becomes $r=iR$.

The gear wheels with the ratio i result in that, compared with drive pulleys of the radius R, the mass moment of inertia of drive pulleys of the radius r is less by the factor $i^5$ and, reduced to the drive shaft of the periodic gear, is less by the factor $i^3$, if it is assumed that the ratio of width to radius of the pulleys remains constant.

Now, since in connection with a predetermined stress, drive pulleys for conveyor belts are of a considerably larger size than gear wheels, the mass moment of inertia reduced to the drive shaft of the periodic gear has a considerably lower value, even when the additional gear wheels are taken into consideration. Because of this, a lower torque is created for the deceleration and acceleration of the conveyor belt.

In connection with products with relative small mass in particular, angle ranges $\phi_V$ and $\phi_B$ and symmetrical time-dependent cycles of the deceleration and acceleration of the power take-off shaft of the periodic gear result in the same size of the extreme values of deceleration and acceleration, and therefore in a minimum of the otherwise largest size of the extreme values. In such a case, the shaft spacing distance between the reversing pulleys of the intermediate conveyor belt must satisfy the relationship "a"=$\pi r/i$.

In order to transfer the products at the start and end of the intermediate conveyor belt without a gap, it is provided in accordance with the preferred embodiment of the invention that the conveyor belts have belts which are respectively disposed parallel at a distance, wherein reversing pulleys of the inlet conveyor belt are seated on the one side, and reversing pulleys of the outlet conveyor belt are seated on the other side between the spaces of the reversing pulleys at the ends of the intermediate conveyor belts.

To prevent mutual displacement of the products to be transported because of the slipping of the conveyor belts, it is possible to use toothed belts, whose teeth are in engagement with toothed belt pulleys, wherein the toothed drive belt pulleys of the intermediate conveyor belt have reference circles with a radius r.

Furthermore, in order to convey the products free of slippage with respect to the intermediate conveyor belt during an acceleration or deceleration phase, the intermediate conveyor belt can consist of a lower conveyor belt and, parallel with it, an upper conveyor belt, whose working sides, which face each other, move in the same direction and synchronously, wherein pulleys resiliently placed against them generate a frictional connection between the working side and the products.

To prevent blows in the teeth because of flank changes of the teeth caused by the change between acceleration and deceleration phases as well as the reduction of the carrying capacity caused by this, gear wheel trains are provided in a further embodiment of the invention, which can be preset in accordance with the torque by means of couplings in such a way that no contact change of the tooth flanks occurs. Research has found that the additional mass required by this does not remove the advantage of small drive pulleys of the intermediate conveyor belt in respect to the reduced mass moment of inertia at the drive shaft of the periodic gear.

BRIEF DESCRIPTION OF THE DRAWINGS

While the novel features of the device for conveying flat floppy products in accordance with the present invention are set forth with particularity in thee appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
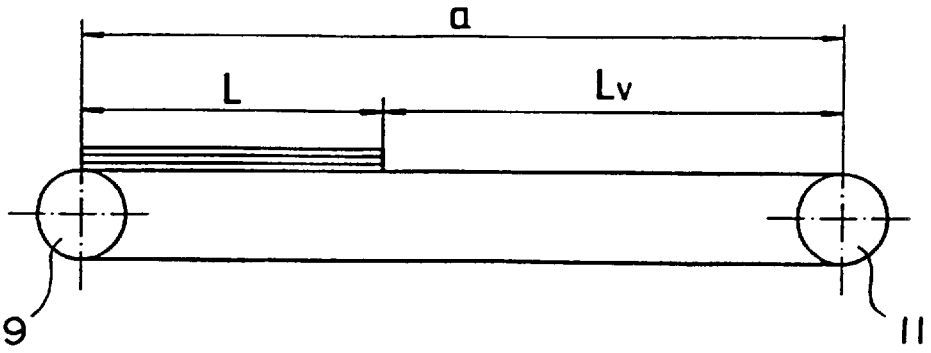
FIG. 1 is a schematic illustration of an intermediate conveyor belt for use in conveying flat floppy products in accordance with the present invention.

FIG. 1 shows the intermediate conveyor belt schematically, wherein the shaft spacing distance "a" between the reversing pulleys or the length of the intermediate conveyor is composed of the product length L and the deceleration path $L_V$ for decelerating the products.

Figure 2:
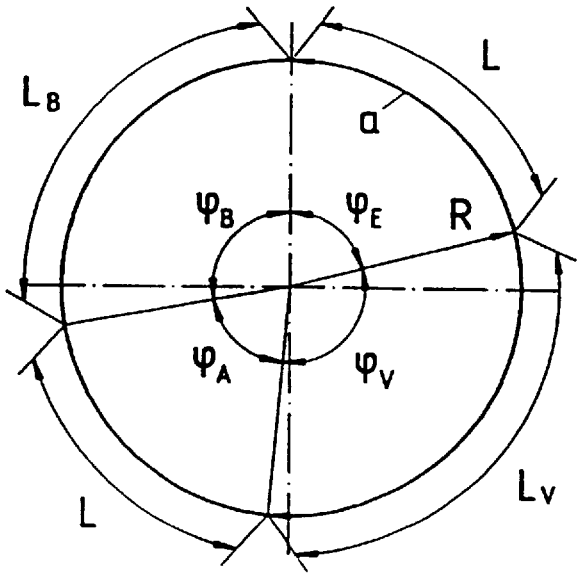
FIG. 2 is a schematic side elevation view of a replacement or theoretical roller with a radius R.

The theoretical or replacement pulley with the radius R is shown in FIG. 2. The angle range $\phi_E$ for the constant inlet velocity $V_E$ is a part of the arc of a circle of the length L. The angle range $\phi_V$ for the deceleration area is a part of the arc of a circle of the length $L_V$. The angle range $\phi_A=\phi_E$ for the constant outlet velocity $v_A$ is a part of the arc of a circle of the length L. The angle range $\phi_B$ for the acceleration area is a part of the arc of a circle of the length $L_B$. FIG. 2 furthermore shows the arc of a circle of the length "a" of the shaft spacing distance between the reversing pulleys of the intermediate conveyor belt. This is the sum of the lengths L and Lv.

Figure 3:
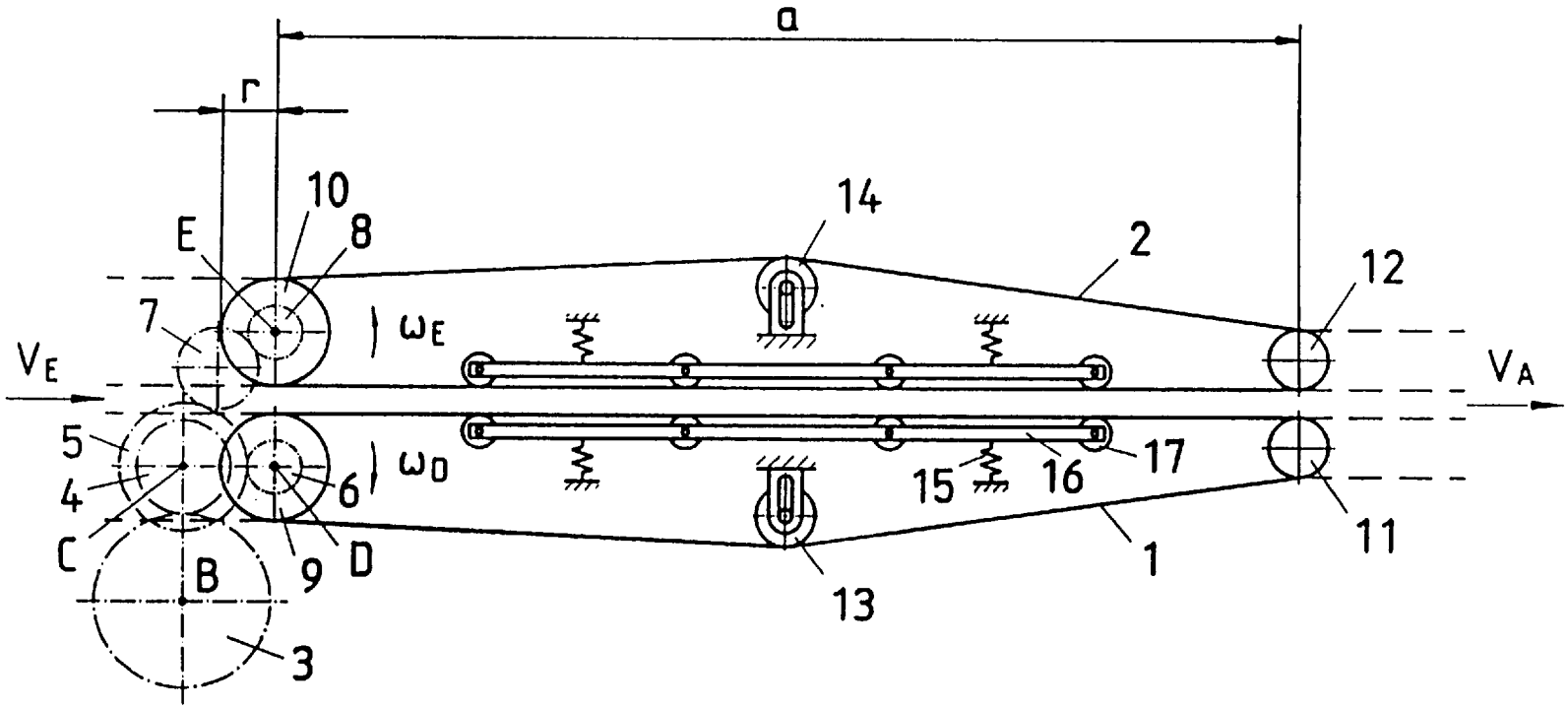
FIG. 3 shows a schematic side view of the intermediate conveyor belt and the pitch circles of the gear wheels.

FIG. 3 schematically shows a lateral view of the intermediate conveyor belt and of the pitch circles of gear wheels. 1 indicates the lower conveyor belt, 2 the upper conveyor belt, 3 the output gear wheel on the power take-off shaft B of the periodic gear, 4 and 5 gear wheels on the shaft C, 6 the gear wheel on the shaft D, 7 an intermediate gear wheel and 8 the gear wheel on the shaft E. The shaft D is connected with the toothed drive belt pulleys 9 of the lower conveyor belts and the shaft E is connected with the toothed drive belt pulleys 10 of the upper conveyor belts. The toothed drive belt pulleys 9 and 10 have the geometrical radius r. The toothed belt pulleys 11 and 12 are used for reversing the toothed belts. The shaft spacing distance between the shaft D of the toothed belt drive pulley 9 and the shaft of the toothed belt reversing pulley 11, or between the shaft E of the toothed belt drive pulley 10 and the toothed belt reversing pulley 12 of the intermediate conveyor belts. $omega_D$ and $omega_E$ indicate the oppositely directed angular speeds of the same magnitude of the shafts D and E. The adjustable toothed belt pulleys 13 and 14 generate the necessary prestress of the conveyor belts 1 and 2. Springs 15 press the toothed belt pulleys 17 seated in beams 16 against the sheet packages through the toothed belts 1 and 2, which packages are conveyed in this way in a frictionally connected manner. The vector $v_E$ identifies the velocity of the inlet conveyor belt and the vector $v_A$ identifies the velocity of the outlet conveyor belt.

Figure 4:
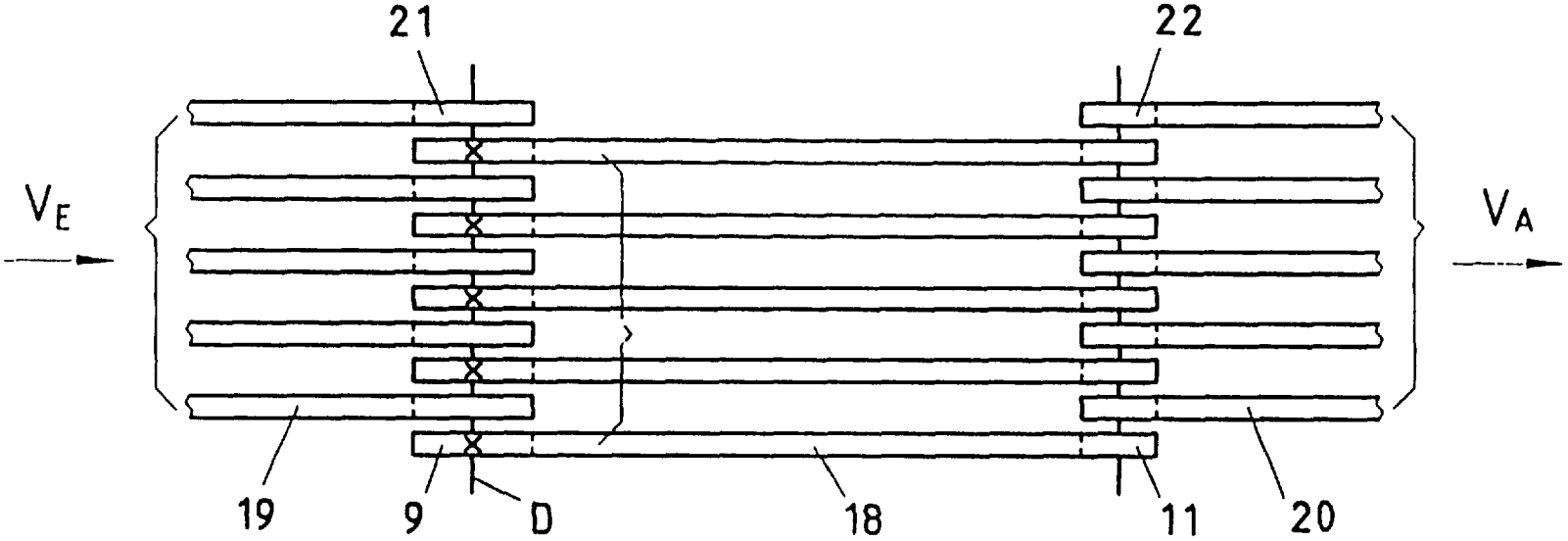
FIG. 4 represents the meshing of the toothed lower intermediate conveyor belt with the toothed belts of the inlet conveyor.

FIG. 4 represents the meshing of the toothed belts 18 of the lower conveyor belt 1 with the toothed belts 19 of the inlet conveyor belt and with the toothed belts 20 of the outlet conveyor belt, respectively at the transfer places for the sheet package. The toothed reversing belt pulleys 21 of the inlet conveyor belt are seated between the toothed drive belt pulleys 9, and the toothed reversing belt pulleys 22 of the outlet conveyor belt are seated between the toothed reversing belt pulleys 11.

Figure 5:
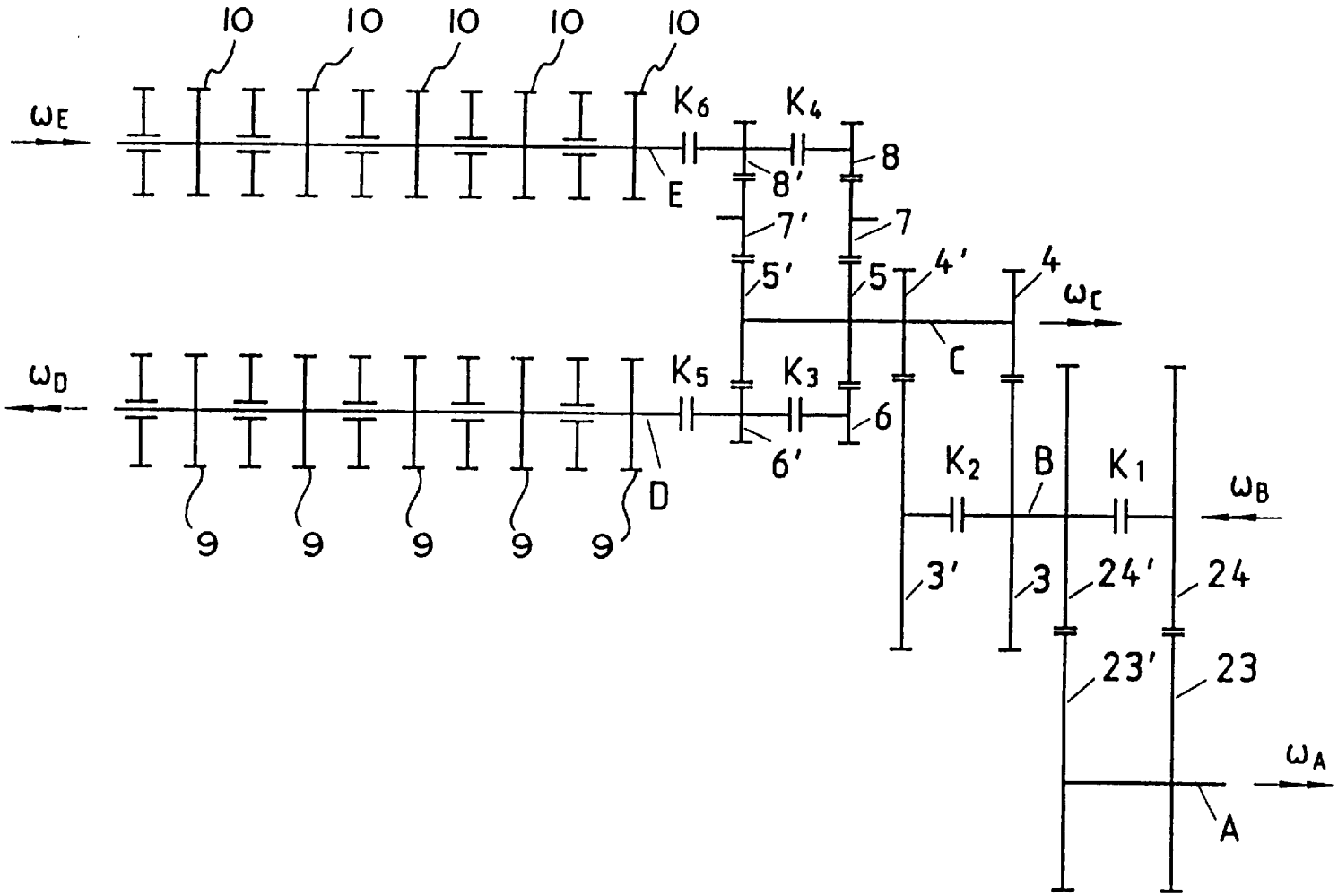
FIG. 5 is a schematic representation of an axial section through the intermediate conveyor belt.

FIG. 5 schematically represents an axial section through the intermediate conveyor belt, of the gear wheels with the constant ratio i and of the periodic gear 23 and 23 with the drive shaft A and the periodic gear 24 and 24' of the power take-off shaft B. The shafts A, B, C, D and E have angular speeds of $omega_A$, $omega_B$, $omega_C$, $omerga_D$ and $omega_E$. Two equal, parallel arranged wheel sets are provided in each gear step, wherein the torque of the gear periodic wheels 23, 24 and 23', 24' can be prestressed by means of the coupling $K_1$, the gear wheels 3, 4 and 3', 4' by means of the coupling $K_2$, the gear wheels 5, 6 and 5', 6' by means of the coupling $K_3$ and the gear wheels 5, 7, 8 and 5', 7', 8' by means of the coupling $K_4$. The coupling $K_5$ is used to connect the shaft D and the coupling $K_6$ for connecting the shaft E of the intermediate conveyor belt.

Figure 6:
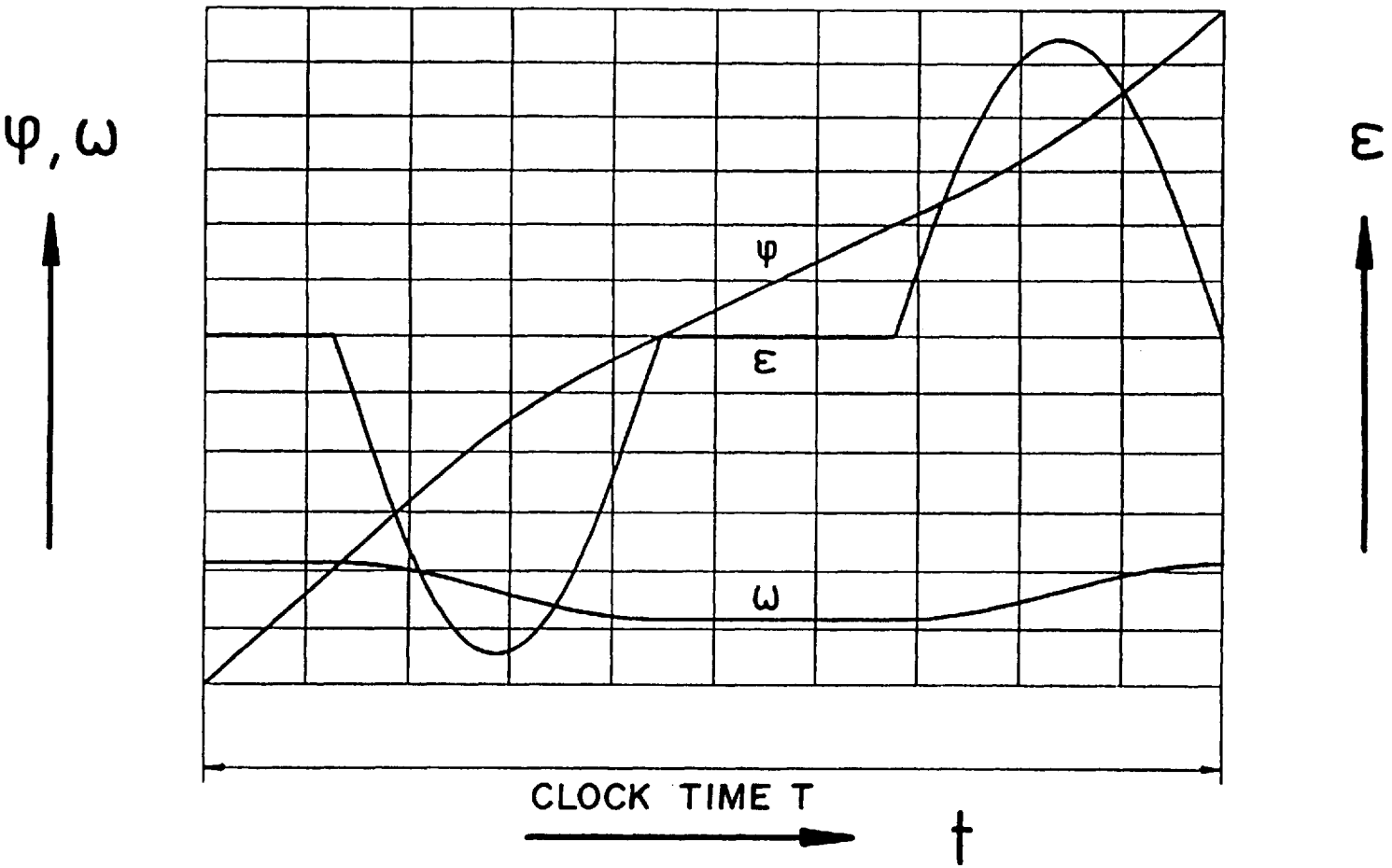
FIG. 6 is a graphical illustration of the cycles of deceleration or acceleration of the intermediate conveyor belts.

For the required movement cycle of the intermediate conveyor belt, FIG. 6 represents the cycles of the predetermined angular deceleration or acceleration $\epsilon$, the angular velocity omega and the angle of rotation $\phi$ as a function of the time t for one period, i.e. for the clock time T, which are to be realized by the periodic gear. omega is the result of the integration of $\epsilon$, and $\phi$ of the integration of omega.

Figure 7:
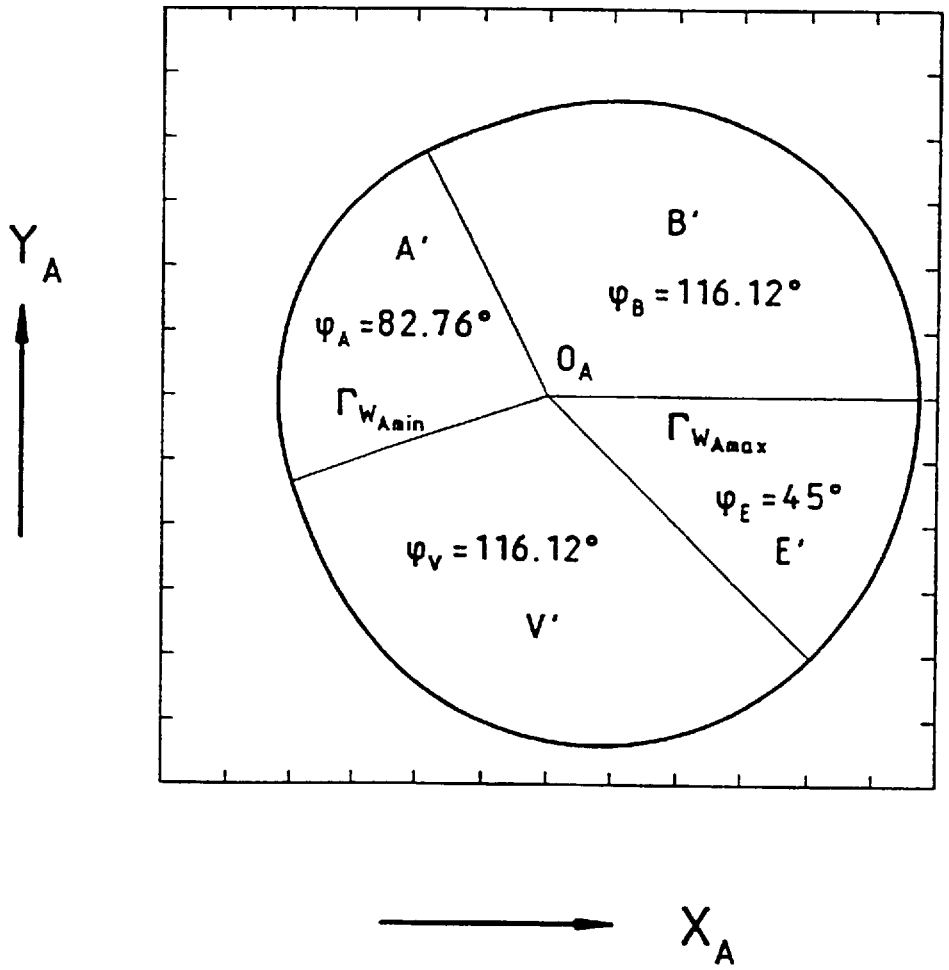
FIG. 7 depicts the contact curve of the gear wheel seated on the shaft A.
Figure 8:
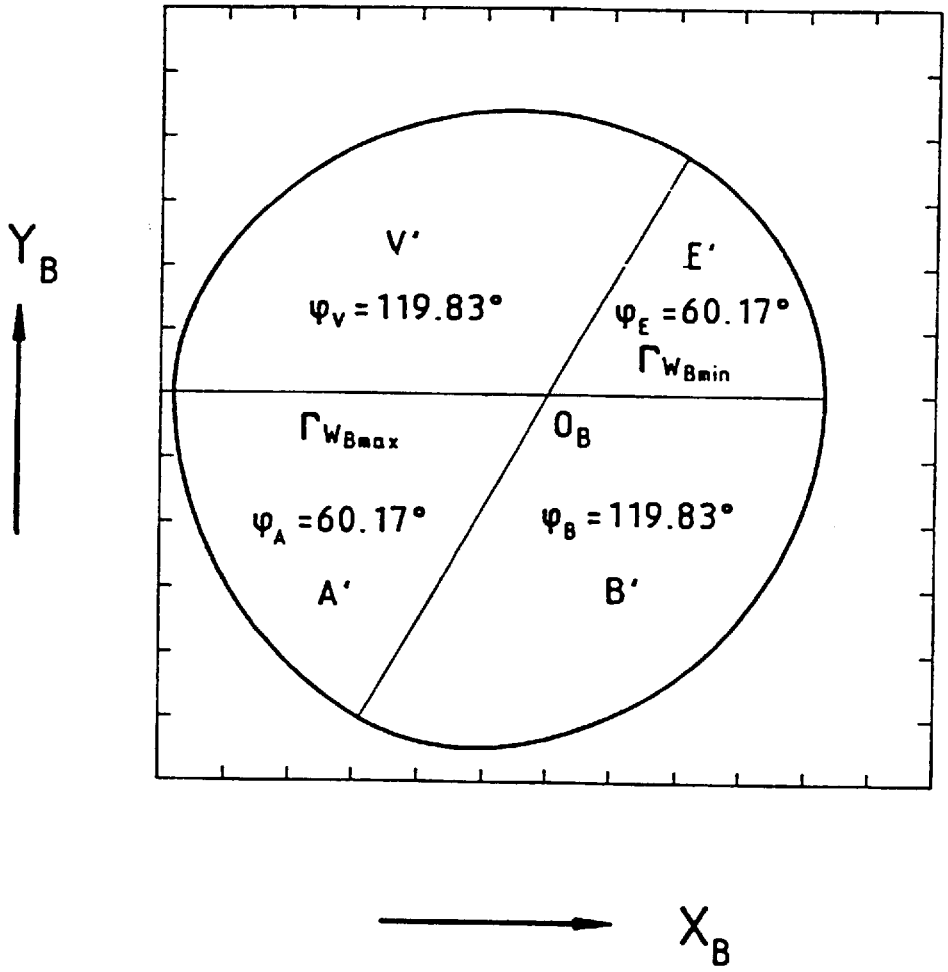
FIG. 8 is similar to FIG. 7 and shows the contact curve of the gear wheel seated on the shaft B.

In the preferred embodiment the periodic gears consist of non-circular wheels which comply with the movement cycle in accordance with FIG. 6. FIG. 7 shows the contact curve of the periodic gear wheels 23 and 23' seated on the shaft A with the center $O_A$, and the minimum radius of the contact curve $r_{WAmin}$ as well as the maximum radius of the contact curve $r_{WAmax}$. The shaft A rotates at a constant angular speed. FIG. 8 shows, analogously to FIG. 7, the contact curve of the periodic gear wheels 24 and 24' seated on the shaft B with the center $O_B$, with $r_{WBmin}$ as the minimum and $r_{WBmax}$ as the maximum radius of the contact curve. In FIGS. 7 and 8, E' identifies the angle ranges for the constant velocity $v_E$, V' the angle ranges for the deceleration phase, A' the angle ranges for the constant velocity $v_A$ and B' the angle ranges for the acceleration phase of the intermediate conveyor belts 1 and 2. The contact curves of the non-circular periodic gear wheels 23 and 23' and 24 and 24' roll off on each other without sliding. The curve lengths which are part of the respective angular ranges are therefore all of the same length. The contact curves can be described by the coordinates $X_A$, $Y_A$ and $X_B$, $Y_B$.

Figure 9:
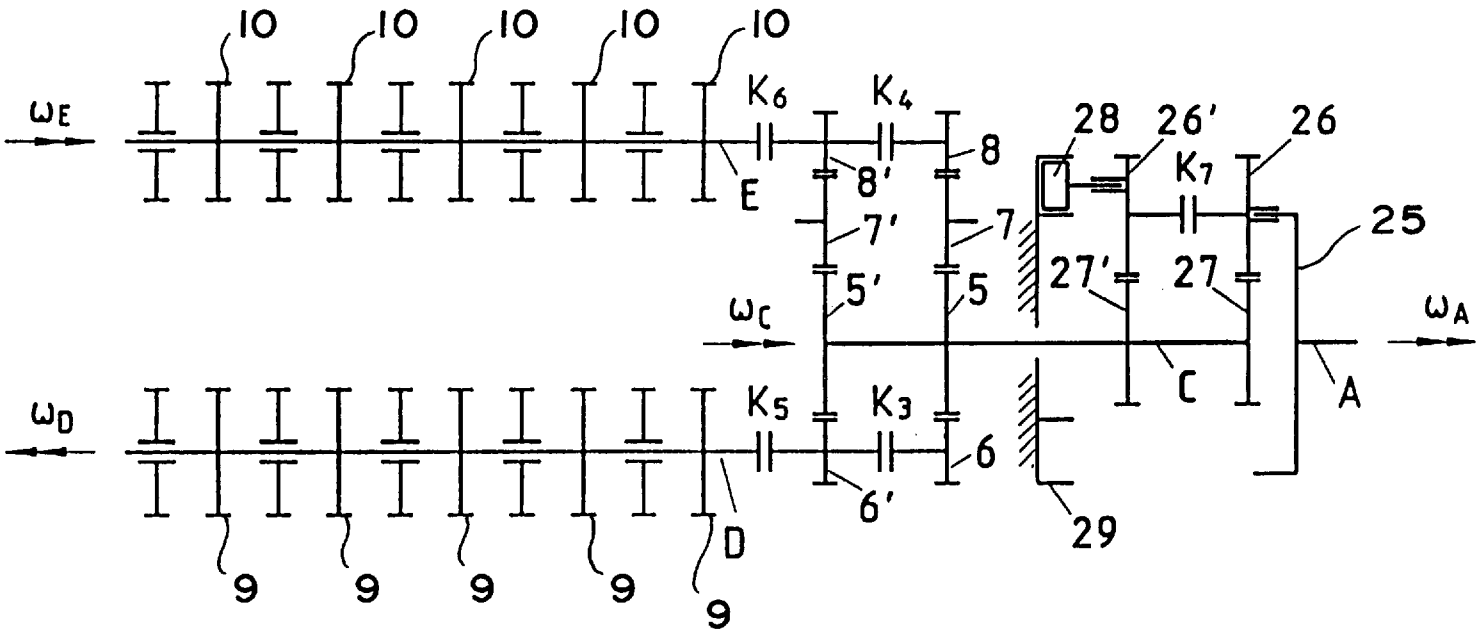
FIG. 9 is similar to FIG. 5 and shows an axial section of the intermediate conveyor belt.

Analogously to FIG. 5, FIG. 9 shows the axial section of the intermediate conveyor belt with a gear wherein, instead of the periodic gear with non-circular gear wheels, an also known periodic gear with round gear wheels in an arrangement of a planetary gear with the planetary gear support 25, the planetary gear wheels 26 and 26' and the sun gear wheels 27 and 27' is provided. The torque of the wheels 26, 27 and

26', 27' can be prestressed by means of the coupling $K_7$. The roller 28, seated eccentrically in the planetary wheel 26', rolls off the cam disk 29, supports the torque of the planetary wheels and superimposes the periodic movement cycle in accordance with FIG. 6 on the planetary gear wheels 26 and 26' which transfer the movement to the shaft C, instead of to the shaft B in FIG. 5. The gear wheel-planetary gear already acts in the sense of the invention as a stage of the gear wheels, which must realize the constant gear ratio i=r/R.

While a preferred embodiment of a device for conveying flat floppy products in accordance with the present invention has been set forth fully and completely hereinabove, it will be apparent to one of skill in the art that a number of changes in, for example, the specific product being conveyed, the number of individual conveying belts, the type of printing unit being used and the like may be made without departing from the true spirit and scope of the present invention which is accordingly to be limited only by the following claims.

We claim:

1. A device for conveying flat floppy products having a product length and for changing a velocity of said conveyed products over a time period comprising:

an inlet conveyor having a first, inlet conveyor constant velocity;

an outlet conveyor having a second, outlet conveyor constant velocity, said second, outlet conveyor constant velocity being different from said first, inlet conveyor constant velocity, said outlet conveyor being located downstream, in a direction of conveyance of said conveyed products from said inlet conveyor;

an intermediate conveyor located intermediate said inlet conveyor and said outlet conveyor, said intermediate conveyor having a third, intermediate conveyor variable velocity, said third, intermediate conveyor variable velocity varying periodically from said first velocity to said second velocity and back to said first velocity during twice each said time period, said intermediate conveyor having a product travel path length which is the sum of said product length plus a product velocity varying length said intermediate conveyor including drive pulleys and reversing pulleys spaced from each other in said direction of conveyance by said product travel length; and, a gear drive means for said intermediate conveyor, said gear drive means driving said intermediate conveyor at said third intermediate conveyor variable velocity to vary said velocity of said conveyed products from said first velocity to said second velocity while said conveyed products travel along said product travel path length, said gear drive means including periodically chancing gears having a periodic cycle during each said time period, and intermediate gear wheels, said intermediate gear wheels connecting said periodically changing gears to said drive pulleys of said intermediate conveyor.

2. The device of claim 7 wherein said inlet conveyor has spaced inlet conveyor belts, said outlet conveyor has spaced outlet conveyor belts and said intermediate conveyor has spaced intermediate conveyor belts.

3. The device of claim 2 further including spaced inlet conveyor belt reversing pulleys for said spaced inlet conveyor belts and a plurality of said drive pulleys for said spaced intermediate conveyor belts, said inlet conveyor belt reversing pulleys being situated between said drive pulleys for said spaced intermediate conveyor belts.

4. The device of claim 3 further including spaced outlet conveyor belt drive pulleys for said spaced outlet conveyor belts, and a plurality of said reversing pulleys for said spaced intermediate conveyor belts, said outlet conveyor belt drive pulleys being situated between said reversing pulleys for said spaced intermediate conveyor belts.

5. The device of claim 2 wherein said inlet conveyor belts, said outlet conveyor belts, and said intermediate conveyor belts are toothed belts.

6. The device of claim 1 wherein said intermediate conveyor includes a lower intermediate conveyor belt and an upper intermediate conveyor belt, each of said lower and upper intermediate conveyor belts having a working side, said working sides facing each other and moving synchronously in the same direction during conveying of a product.

7. The device of claim 6 further including spring biased belt pulley in engagement with said lower intermediate conveyor belt and said upper intermediate conveyor belt, said spring biased belt pulleys pressing said working sides of said lower and upper intermediate conveyor belts together.

8. The device of claim 1 wherein said periodically changing gears include cooperating non-circular gears.

9. The device of claim 1 wherein said periodically changing gears include a planetary gear, and a sun gear.

* * * * *